US007854355B2

(12) United States Patent
Rossignol

(10) Patent No.: US 7,854,355 B2
(45) Date of Patent: Dec. 21, 2010

(54) PRODIGIO PUMP

(75) Inventor: Eric Rossignol, Chalon sur Saone (FR)

(73) Assignee: Rexam Dispensing SMT S.A. (FR)

( * ) Notice: Subject to any disclaimer, the term of this patent is extended or adjusted under 35 U.S.C. 154(b) by 735 days.

(21) Appl. No.: 11/752,720

(22) Filed: May 23, 2007

(65) Prior Publication Data

US 2008/0251542 A1 Oct. 16, 2008

(30) Foreign Application Priority Data

Apr. 12, 2007 (FR) ..... 07 02677

(51) Int. Cl.
*B67D 3/00* (2006.01)

(52) U.S. Cl. ..... 222/380; 222/387; 222/321.7; 222/402.13; 222/518; 239/354

(58) Field of Classification Search ..... 222/380, 222/321.7, 387, 321.9, 402.13, 402.1, 402.15, 222/518; 239/354
See application file for complete search history.

(56) References Cited

U.S. PATENT DOCUMENTS

| | | | | |
|---|---|---|---|---|
| 5,465,873 | A | 11/1995 | Mejean et al. | 222/47 |
| 6,880,731 | B2 * | 4/2005 | Heukamp | 222/321.7 |
| 6,966,465 | B2 * | 11/2005 | Kang, III | 222/321.9 |
| 7,172,098 | B2 * | 2/2007 | Garcia et al. | 222/402.13 |

FOREIGN PATENT DOCUMENTS

| | | |
|---|---|---|
| DE | 42 10 225 | 9/1993 |
| EP | 0 461 894 | 12/1991 |
| FR | 28 38 070 | 10/2003 |
| WO | WO 02/30781 | 4/2002 |

OTHER PUBLICATIONS

French Search Report, Dec. 20, 2004, 2 pages.

* cited by examiner

*Primary Examiner*—Kevin P Shaver
*Assistant Examiner*—Melvin A Cartagena
(74) *Attorney, Agent, or Firm*—St. Onge Steward Johnston & Reens LLC

(57) ABSTRACT

A pump for dispensing a liquid contained in a bottle including a shrunk-fit section including an orifice for communicating with the liquid, a pushbutton including an orifice for ejecting the liquid, a dosing sleeve integrating a needle for plugging the ejection orifice and a device for bi-directional movement of the needle, a dosing piston including a channel equipped with a closing valve for the orifice, the piston being mounted in translation, in a leak-tight manner, inside the shrunk-fit section, between an open position and a closed position of the orifice, by means of the valve, an actuating member integral with the device for moving the needle and slidably mounted inside the dosing piston, by pressing on the pushbutton, the sliding assembly being set up to actuate the moving device and to position the valve in closed position so as to enable ejection of the liquid from the dosing chamber.

17 Claims, 3 Drawing Sheets

PRODIGIO PUMP

CROSS-REFERENCE TO RELATED APPLICATIONS

The present application claims priority of French Patent Application No. 07 02677 filed on Apr. 12, 2007, the content of which is incorporated herein by reference.

FIELD OF THE INVENTION

This invention relates to a pump intended to be mounted on a bottle so as to enable dispensing of a liquid contained in said bottle, as well as a bottle containing a liquid product on which such a pump is mounted. In one particular application, the liquid is of the gel or cream type, e.g., for use in cosmetics or for pharmaceutical treatments.

BACKGROUND OF THE INVENTION

Pumps having the following properties are known:

- leak-tight closure of the ejection orifice so as to limit contacts between the outside air and the liquid being held inside the pump, in particular to prevent said liquid from drying out and/or degrading over time;
- absence of contact between the liquid and metal parts, so as to prevent possible physicochemical degradations of the liquid;
- absence of any passage for recirculation of air into the bottle in compensation for the restored product.

The invention aims to simplify the production of such pumps by proposing a design consisting of parts that are simple to produce and limited in number.

Furthermore, the pump according to the invention proposes a sealing of the closure which is improved so as to be able to dispense liquids having a significant sensitivity to air. Consequently, the combined use of a pump according to the invention with a bottle containing an air-sensitive liquid is particularly advantageous.

In particular, anticipated as being sensitive to air are liquids containing a solvent likely to evaporate quickly, e.g., alcohol-based or water-based, or containing photosensitive substances, e.g., sunscreens, or easily oxidised, e.g., vitamins, particularly vitamin C.

In addition, the operation of the pump according to the invention limits the pressurisation of the liquid during dispensing. Thus, the combined use of a pump according to the invention with a bottle containing a liquid sensitive to mechanical stresses is also particularly advantageous.

In particular, anticipated as being sensitive to mechanical stresses are liquids, e.g., creams, likely to undergo a physicochemical transformation under pressure, in particular separation or a phase change.

The operation of the pump according to the invention also enables the dispensing of particularly viscous liquids.

SUMMARY OF THE INVENTION

In order to attain these various improvements of the pumps according to the prior art, according to a first aspect, the invention proposes a pump intended to be mounted on a bottle so as to enable the dispensing of a liquid contained in said bottle, said pump including:

- a shrunk-fit section intended to be firmly fastened to the bottle, said shrunk-fit section including an orifice communicating with the liquid;

- a pushbutton including an orifice for ejecting the liquid, said pushbutton being mounted in translation on said shrunk-fit section, restrained by an elastic return means;
- a dosing sleeve mounted in said pushbutton, said sleeve integrating a needle for plugging the ejection orifice and a device for bi-directional movement of said needle between a plugging position and an ejection position;
- a dosing piston including a channel for dispensing the liquid, said channel being equipped with a closing valve for the orifice, said piston being mounted in translation, in a leak-tight manner, in said shrunk-fit section, between an open position and a closed position of the orifice, by means of the valve, said sleeve and said piston being mounted in translation, in a leak-tight manner, in relation to each other, so as to define between them a dosing chamber for the liquid;
- an actuating member integral with the needle-moving device and mounted slidably inside the dosing piston, by pressing on the pushbutton, said sliding assembly being set up to actuate the moving device and to position the valve in closed position, so as to enable ejection of the liquid from the dosing chamber.

According to a second aspect, the invention proposes a bottle containing a liquid product, said bottle including a ring on which the shrunk-fit section of such a pump is mounted, with the orifice in communication with the liquid.

Other objects and advantages of the invention will become apparent in the following description made with reference to the appended FIGS. 1 to 6.

DETAILED DESCRIPTION OF THE INVENTION

Figure 2:
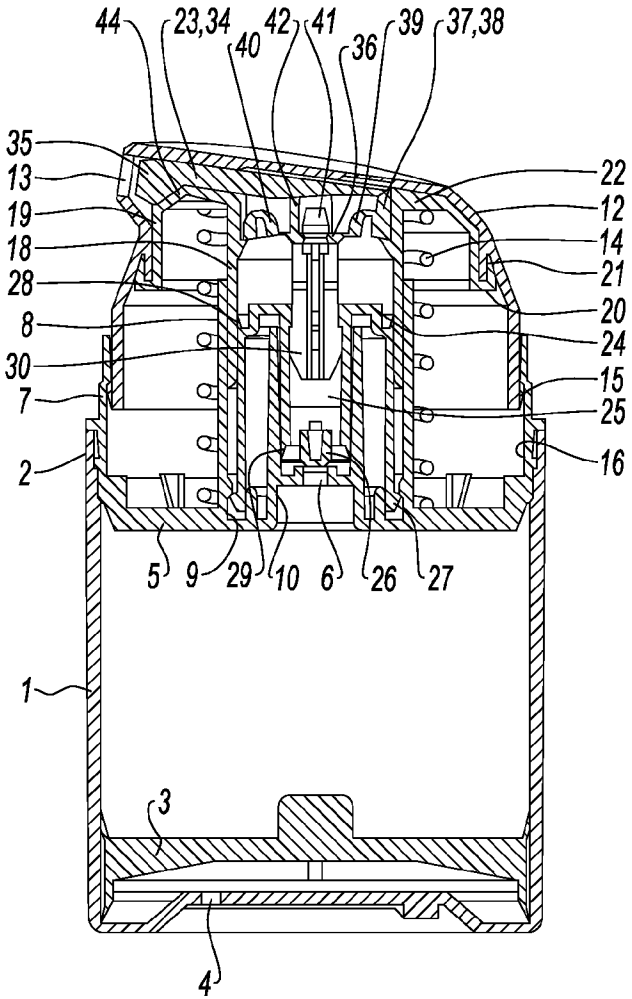
FIG. 2 is a longitudinal cross-sectional view of the bottle of FIG. 1 in a liquid-ejecting position.

In the description, the spatial positioning terms are taken in reference to the position of the pump shown in the figures.

In relation to the figures, an embodiment of a pump is described, which is mounted on a bottle so as to enable the dispensing of a liquid contained in said bottle. In one application example, the liquid is a gel or a cream, for cosmetic use or for pharmaceutical treatments.

The bottle includes a body 1 surmounted by a ring 2 onto which the pump is mounted. Furthermore, a liquid delivery piston 3 is slidably mounted in said body 1 so as to push the liquid into said pump in order to dispense it without any recirculation of air. In order to do so, the bottle includes a vent hole 4 opposite the pump. Although the description is made with respect to dispensing without any recirculation of air, the pump according to the invention can be used with other types of dispensing.

The pump includes a shrunk-fit section 5 fastened firmly inside the ring 2 of the bottle, said shrunk-fit section including an orifice 6 for placing the pump in communication with the liquid contained in the body 1. More precisely, the shrunk-fit section 5 is mounted onto the ring 2 in a leak-tight manner, with the orifice 6 in communication with the liquid.

The shrunk-fit section 5 can be made by moulding a plastic material, in particular polypropylene, and includes a bottom in which the orifice 6 is formed axially. In addition, the shrunk-fit section 5 has a rotating cylindrical geometry and, extending from the bottom concentrically are:

- an exterior sleeve 7 a portion of the exterior surface of which is fitted into the ring 2;
- an interior sleeve 8 the lower end of which is provided with a groove 9; and
- a centre sleeve 10 on the lower wall of which the dispensing orifice 6 is formed.

In addition, in the embodiment shown, the bottle includes a cap 11 which is mounted on the outside of the exterior sleeve 7, above the portion fitted into the ring 2.

The pump includes a pushbutton 12 which is provided with an ejection orifice 13 for the liquid, said pushbutton being mounted in translation on the shrunk-fit section 5, restrained by an elastic return means consisting of a spring 14. More precisely, the pushbutton includes a skirt provided with an orifice 13 for substantially radial ejection. The skirt further includes an annular bead 15 which, during translational travel, cooperates with a groove 16 formed on the exterior sleeve 7.

The pump also includes a dosing sleeve 18 which is mounted in the pushbutton 12 in order to be integral with it during translational travel The sleeve 18 is surrounded by an exterior skirt 19 which includes an annular rim 20 cooperating with a groove 21 formed in the skirt of the pushbutton 12, so as to form a leak-tight connection area between said sleeve and said pushbutton.

In addition, the radial connecting wall 22 between the skirt 19 and the sleeve 18 forms a stop-motion surface for the spring 14, said spring being further arranged around the interior sleeve 8 of the shrunk-fit section 5.

The dosing sleeve 18 also integrates, in a single piece, e.g., made via moulding, a needle 23 for plugging the ejection orifice 13 and a device for bi-directional movement of said needle between a plugging position and an ejection position. In particular, the needle 23 is arranged inside the leak-tight volume formed in the upper portion of the pushbutton 12, and more precisely beneath the upper wall of said pushbutton. In order to enable passage of the liquid towards the ejection orifice 13, orifices are provided on the upper portion of the dosing sleeve 18.

The pump also includes a dosing piston 24 which includes a channel 25 for dispensing the liquid, said channel being equipped with a closing valve 26 for the orifice 6. The dosing piston 24 has a rotating cylindrical geometry, and can be made by moulding a plastic material.

The piston 24 is mounted in translation, in a leak-tight manner, inside the shrunk-fit section 5, between an open position and a closed position of the orifice 6, by means of the valve 26. In addition, the dosing sleeve 18 and the piston 24 are mounted in translation, in a leak-tight manner, in relation to each other, so as to define between them a dosing chamber for the liquid.

More precisely, the exterior wall of the dosing piston 24 is slidably mounted in a leak-tight manner inside the interior sleeve 8, by means of the dosing sleeve 18. In order to do so, the exterior wall of the dosing piston 24 includes:

- at its lower portion, a bead 27 which cooperates with the groove 9 formed in the interior sleeve 8, so as to define the travel of the dosing piston 24 between the open and closed positions of the valve 26;
- at its lower portion, an annular sealing lip 28 which is in frictional contact on interior wall of the dosing sleeve 18.

In addition, the dispensing channel 25 is slidably mounted in a leak-tight manner inside the centre sleeve 10. The valve 26 consists of a pin which, in closed position, becomes engaged in a leak-tight manner inside the dispensing orifice 6, said pin being mounted in the lower end of the channel 26 by means of bridges of material allowing the passage of liquid around said pin in open position. Furthermore, an annular sealing lip 29 is formed on the exterior wall of the channel 25, around the pin, so as to come into frictional contact on the interior wall of the centre sleeve 10.

The pump also includes an actuating member 30, which is integral with the device for moving the needle 23 and slidably mounted inside the dosing piston 24. By pressing on the pushbutton 12, the sliding assembly is set up in order to actuate the moving device and to arrange the valve 26 in closed position, so as to enable ejection of the liquid from the dosing chamber.

The actuating member 30 consists of a rod which is slidably mounted inside the dispensing channel 25, with a sufficient degree of interference to actuate the needle 23 and the valve 26. To do so, the rod is provided with a ring for sliding 31 inside the channel 25, said ring including a rear rim which cooperates with a radial stop-motion device 32 provided on the periphery of the channel 25, so as to define the upper end of travel of said ring inside of said channel. In addition, the actuating member 30, and in particular the ring 31, can be made of a plastic material the hardness of which is greater than that forming the piston 24, e.g., polypropylene for the member 30 and polyethylene for the piston 24.

The actuating member 30 further includes radial fins 33 which extend from the rod so as to form between them axial liquid passages through said member.

In the embodiment described, the needle 23 includes an arm 34 the front end of which is provided with a plugging head 35 which becomes engaged in a leak-tight manner inside the ejection orifice 13. In addition, the rear end of the arm 34 is associated with the dosing sleeve 18 by means of the moving device.

The device for moving the needle 23 includes a flange 36 associated with the actuating member 30 and a link rod 37 designed to convert an axial movement of the actuating member 30 into a translational movement of the arm 34 relative to the pushbutton 12.

In order to accomplish this, the link rod 37 is provided with three hinge joints—internal, external, upper—with said flange, the inside of the dosing sleeve 18 and the rear end of the arm 34, respectively. Furthermore, the link rod 37 is elastically deformable between the internal and external hinge joints.

In addition, the link rod 37 includes a rear wall 38 formed between the external and upper hinge joints and, in the embodiment shown, the link rod 37 includes a bridge of elastically deformable material 39, which is dished so as to connect the rear wall 38 to the flange 36.

The device for moving the needle 23 further includes an elastically deformable element 40 which is provided with an internal hinge joint with the flange 36 and an external hinge joint with the inside of the dosing sleeve 18. The elastically deformable element 40 consists of a bridge of U-shaped material on each end of which the hinge joints are formed. According to the embodiment shown, the hinge joints are produced by material thinning.

The elastically deformable element 40 is provided opposite the link rod 37 in relation to the axis of the dosing sleeve 18. More precisely, the flange 36 has a substantially rectangular geometry each small side of which respectively bears an internal hinge joint. The flange 36 also includes an orifice into which the head 41 of the actuating member 30 is snapped.

In this way, a moving device is obtained, which is particularly reliable and sturdy, in particular in that it provides for double elasticity on either side of the bearing area of the actuating member 30. Furthermore, the arrangement of the actuating member 30 in the moving device is thereby also simplified.

Figure 3:
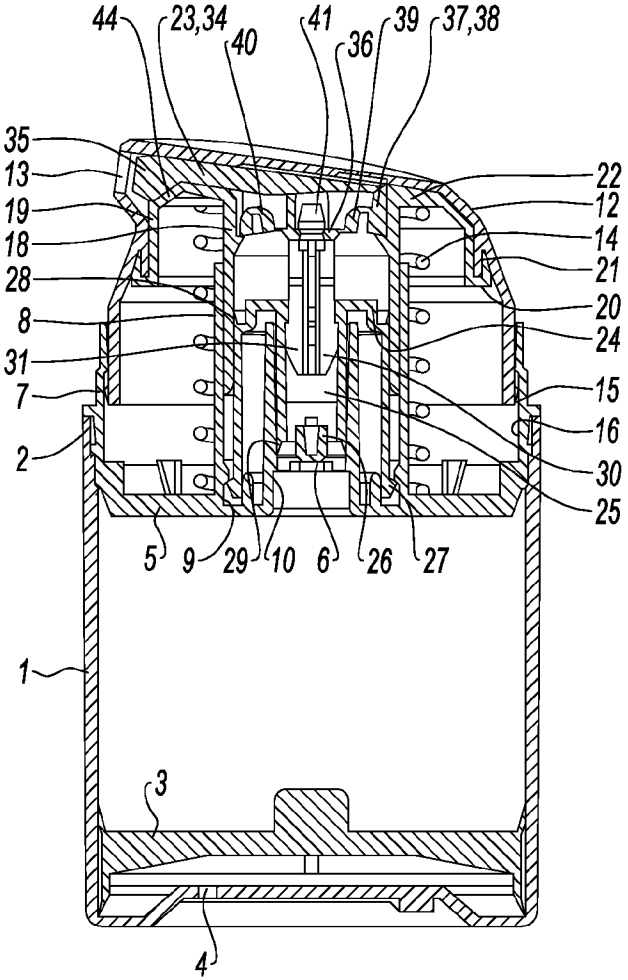
FIG. 3 is another longitudinal cross-sectional view of the bottle of FIG. 1 in the liquid-ejecting position.

Furthermore, in the embodiment shown, in ejection position (FIGS. 2-4):

the orifice is surmounted by an axial wall 42 which comes to bear on the rod 34 of the needle 23;

the sleeve 18 includes an rear stop-motion device 43 for the wall 38; and the geometry of the rear of the plugging head 35 is designed to abut against a complementary surface 44 provided on the skirt 19.

These various means, which could be provided separately, make it possible, in particular, to mechanically hold the needle 23 when it is in ejection position, so as to protect it from the stresses induced by the sliding of the actuating member 30 inside the dispensing channel 25.

Figure 1:
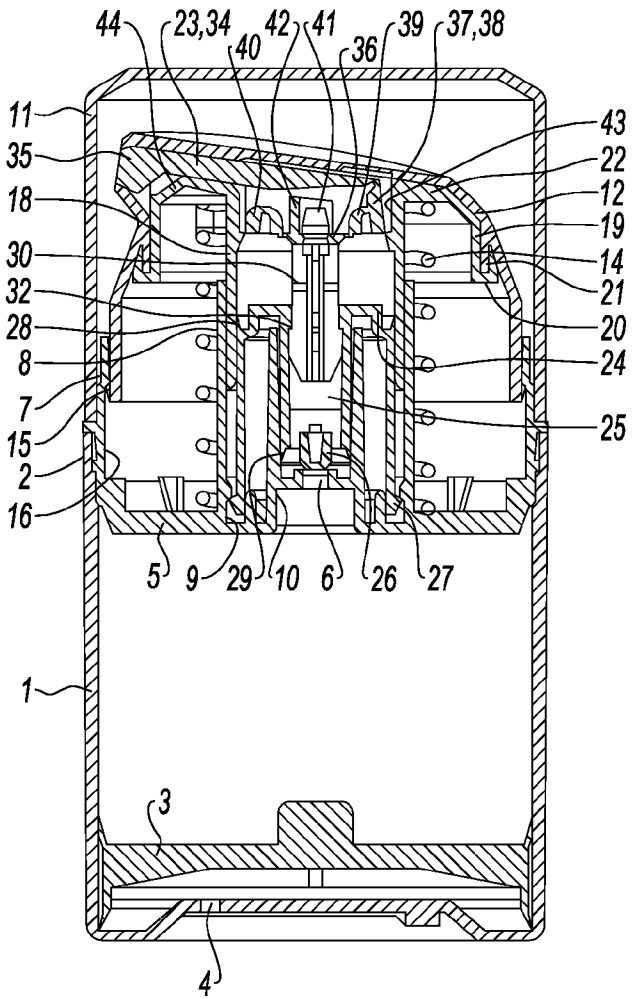
FIG. 1 is a longitudinal cross-sectional view of a bottle equipped with a pump according to one embodiment of the invention in an idle position.

The operation of the pump described above is described in relation to the figures. In idle position (FIG. 1), the valve 26 is in open position and the needle 23 is in plugging position. Furthermore, the stop-motion device 32 provided inside the dispensing channel 25 is arranged so that, under the effects of the return spring, it restrains the actuating member 30 downward, in order to push the head 35 into the ejection orifice 13, by means of the moving device. A good seal is thus obtained at the closure to the ejection orifice 13.

By pressing on the pushbutton 12 (FIG. 2), at the beginning of its dispensing travel, the needle 23 is moved into ejection position by the bearing of the flange 36, which is movable, on the actuating member 30, which is stationary. In order to do so, the force required to move the ring 31 inside the channel 25 is designed to be greater than that required to actuate the moving device by means of the flange 36. It is noted that the opening of the ejection orifice 13 was produced substantially without pressurising the liquid, only by mechanical interaction between the parts of the pump.

Over the remainder of the dispensing travel (FIG. 3), the movement of the pushbutton 12 is transmitted to the dosing piston 24 in order to position the valve 26 in closed position. In order to do so, the force required to move the piston 24 is designed to be less than that required to move the ring 31 inside the channel. As an alternative, a reversal of the conditions shown in FIGS. 2 and 3 might be anticipated, i.e., the valve 26 would first be closed and then the ejection orifice 13 opened.

Figure 4:
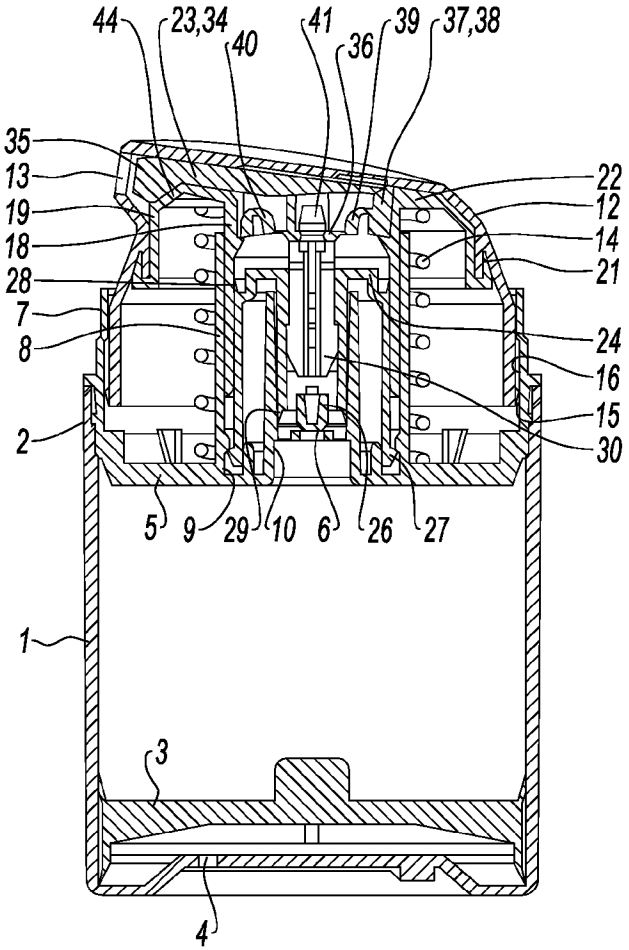
FIG. 4 is another longitudinal cross-sectional view of the bottle of FIG. 1 in the liquid-ejecting position.

In FIG. 4, the ring 31 moves into the channel 25 so as to reduce the volume of the dosing chamber and thus cause the liquid to be dispensed through the ejection orifice 13. During dispensing of the liquid, pressurisation of the liquid is also very limited.

Figure 6:
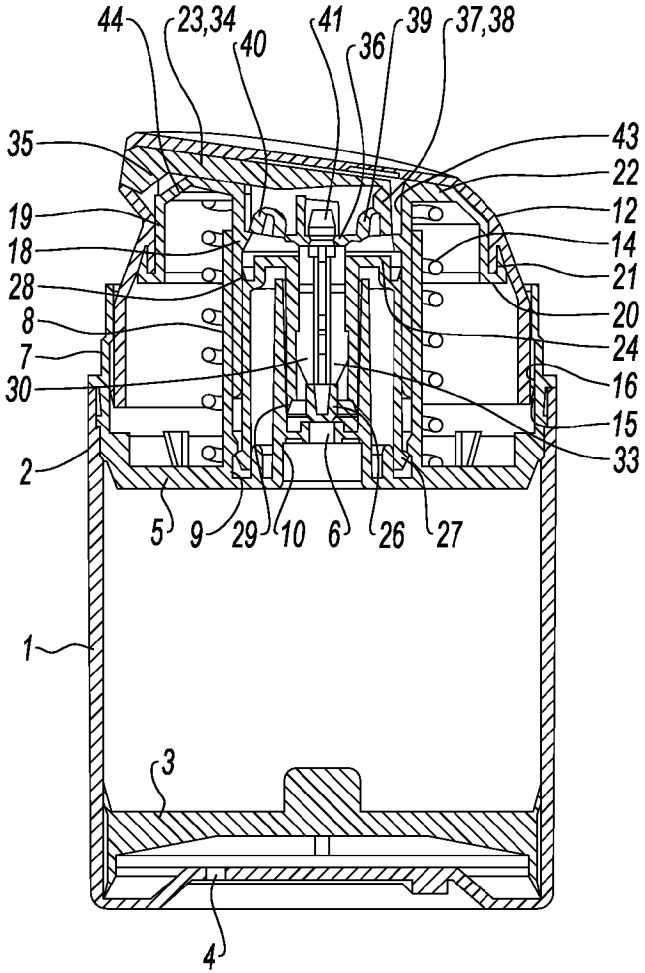
FIG. 6 is a longitudinal cross-sectional view of the bottle of FIG. 1 in an after-use position.
Figure 5:
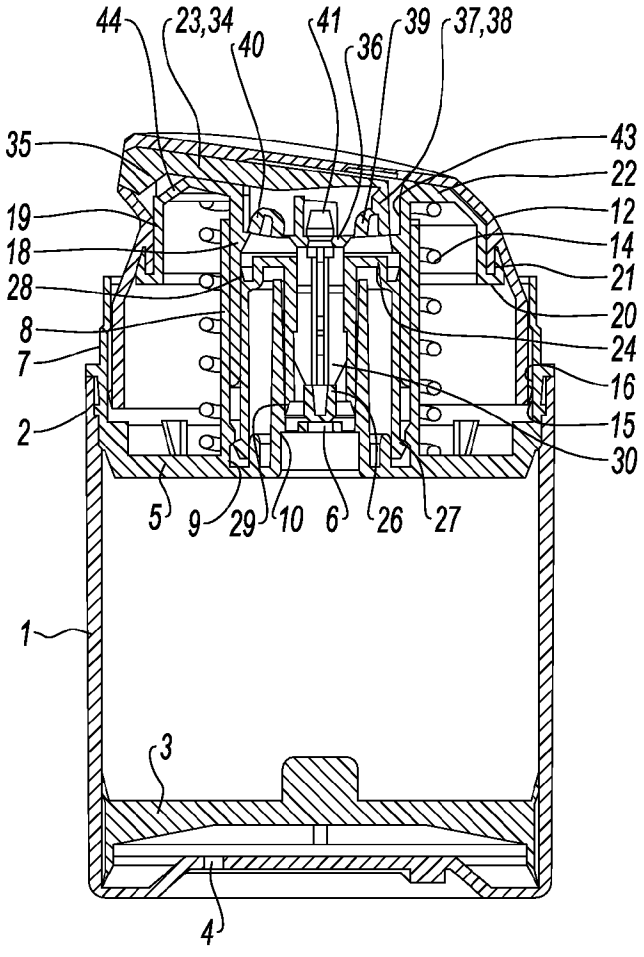
FIG. 5 is a longitudinal cross-sectional view of the bottle of FIG. 1 in a liquid intake position.

FIG. 5 shows the pushbutton 12 at the end of its dispensing travel, immediately before rising back up under the effects of the spring 14. In this figure, stopping pressure on the pushbutton 12 moves the needle 23 into plugging position. Next, the valve 26 is moved into open position (FIG. 6) in order to enable liquid to be sucked into the dosing chamber as the pushbutton 12 rises back up.

What is claimed is:

1. Pump intended to be mounted on a bottle so as to enable the dispensing of a liquid contained in said bottle, said pump including:

a shrunk-fit section intended to be firmly fastened to the bottle, said shrunk-fit section including an orifice communicating with the liquid;

a pushbutton including an orifice for ejecting the liquid, said pushbutton being mounted in translation on said shrunk-fit section, restrained by an elastic return means;

a dosing sleeve mounted in said pushbutton, said sleeve integrating a needle for plugging the ejection orifice and a device for bi-directional movement of said needle between a plugging position and an ejection position;

a dosing piston including a channel for dispensing the liquid, said channel being equipped with a closing valve for the orifice, said piston being mounted in translation, in a leak-tight manner, in said shrunk-fit section, between an open position and a closed position of the orifice, by means of the valve, said sleeve and said piston being mounted in translation, in a leak-tight manner, in relation to each other, so as to define between them a dosing chamber for the liquid;

an actuating member integral with the device for moving the needle and mounted slidably inside the dosing piston, by pressing on the pushbutton, said sliding assembly being set up to actuate the moving device and to position the valve in closed position, so as to enable ejection of the liquid from the dosing chamber; and wherein the needle moves with respect to both said dosing sleeve and said pushbutton.

2. Pump of claim 1, characterised in that the needle includes an arm the front end of which is provided with a plugging head, the rear end of said arm being associated with the dosing sleeve by means of the moving device.

3. Pump of claim 2, characterised in that the device for moving the needle includes a flange associated with the actuating member, said device further including a link rod designed to convert an axial movement of the actuating member into a translational movement of the arm relative to the pushbutton.

4. Pump as claimed in claim 3, characterised in that the actuating member includes a head which is snapped into an orifice provided in the flange.

5. Pump according to claim 2, wherein a rear portion of the plugging head abut against a complementary surface on the skirt in the plugging position.

6. Pump as claimed in claim 1, characterised in that the shrunk-fit section includes an inside sleeve inside of which the exterior wall of the dosing piston is slidably mounted in a leak-tight manner, by means of the dosing sleeve.

7. Pump as claimed in claim 1, characterised in that the shrunk-fit section includes a centre sleeve inside of which the dispensing channel is slidably mounted in a leak-tight manner, the lower wall of said sleeve being provided with communication orifice.

8. Pump as claimed in claim 1, characterised in that the actuating member is slidably mounted inside of the dispensing channel, with a sufficient degree of interference to actuate the needle and the valve.

9. Pump of claim 8, characterised in that the actuating member is provided with a ring for sliding inside the channel, said ring including a rear rim which cooperates with a radial stop-motion device provided on the periphery of the channel.

10. Pump as claimed in claim 8, characterised in that the actuating member includes at least one liquid passage through it.

11. Bottle containing a liquid product, said bottle including a ring onto which the shrunk-fit section of a pump as claimed in claim 1 is mounted, with the orifice in communication with the liquid.

12. Bottle of claim 11, characterised in that it further includes a delivery piston which is slidably mounted inside the bottle so as to push the liquid into said pump in order to dispense it without any recirculation of air.

13. Pump intended to be mounted on a bottle so as to enable the dispensing of a liquid contained in said bottle, said pump including:

a shrunk-fit section intended to be firmly fastened to the bottle, said shrunk-fit section including an orifice communicating with the liquid;

a pushbutton including an orifice for ejecting the liquid, said pushbutton being mounted in translation on said shrunk-fit section, restrained by an elastic return means;

a dosing sleeve mounted in said pushbutton, said sleeve integrating a needle for plugging the ejection orifice and a device for bi-directional movement of said needle between a plugging position and an ejection position;

a dosing piston including a channel for dispensing the liquid, said channel being equipped with a closing valve for the orifice, said piston being mounted in translation, in a leak-tight manner, in said shrunk-fit section, between an open position and a closed position of the orifice, by means of the valve, said sleeve and said piston being mounted in translation, in a leak-tight manner, in relation to each other, so as to define between them a dosing chamber for the liquid;

an actuating member integral with the device for moving the needle and mounted slidably inside the dosing piston, by pressing on the pushbutton, said sliding assembly being set up to actuate the moving device and to position the valve in closed position, so as to enable ejection of the liquid from the dosing chamber;

characterised in that the needle includes an arm the front end of which is provided with a plugging head, the rear end of said arm being associated with the dosing sleeve by means of the moving device, and the device for moving the needle includes a flange associated with the actuating member, said device further including a link rod designed to convert an axial movement of the actuating member into a translational movement of the arm relative to the pushbutton; and further characterised in that the link rod is provided with three hinge joints—internal, external, upper—with the flange, the interior of the dosing sleeve and the rear end of the arm, respectively.

14. Pump of claim 13, characterised in that the link rod includes a rear wall formed between the external and upper hinge joints, the sleeve including a stop-motion device for said wall when the needle is in ejection position.

15. Pump as claimed in claim 13, characterised in that the link rod is elastically deformable between the internal and external hinge joints.

16. Pump intended to be mounted on a bottle so as to enable the dispensing of a liquid contained in said bottle, said pump including:

a shrunk-fit section intended to be firmly fastened to the bottle, said shrunk-fit section including an orifice communicating with the liquid;

a pushbutton including an orifice for ejecting the liquid, said pushbutton being mounted in translation on said shrunk-fit section, restrained by an elastic return means;

a dosing sleeve mounted in said pushbutton, said sleeve integrating a needle for plugging the ejection orifice and a device for bi-directional movement of said needle between a plugging position and an ejection position;

a dosing piston including a channel for dispensing the liquid, said channel being equipped with a closing valve for the orifice, said piston being mounted in translation, in a leak-tight manner, in said shrunk-fit section, between an open position and a closed position of the orifice, by means of the valve, said sleeve and said piston being mounted in translation, in a leak-tight manner, in relation to each other, so as to define between them a dosing chamber for the liquid;

an actuating member integral with the device for moving the needle and mounted slidably inside the dosing piston, by pressing on the pushbutton, said sliding assembly being set up to actuate the moving device and to position the valve in closed position, so as to enable ejection of the liquid from the dosing chamber;

characterised in that the needle includes an arm the front end of which is provided with a plugging head, the rear end of said arm being associated with the dosing sleeve by means of the moving device, and the device for moving the needle includes a flange associated with the actuating member, said device further including a link rod designed to convert an axial movement of the actuating member into a translational movement of the arm relative to the pushbutton; and further characterised in that the device for moving the needle further includes an elastically deformable element provided with an internal hinge joint with the flange and an external hinge joint with the interior of the dosing sleeve.

17. Pump of claim 16, characterised in that the elastically deformable element is provided opposite the link rod in relation to the axis of the dosing sleeve.

* * * * *